US010883224B2

(12) United States Patent
Buschmann

(10) Patent No.: US 10,883,224 B2
(45) Date of Patent: Jan. 5, 2021

(54) METHODS OF PULP FIBER TREATMENT

(71) Applicant: Clean Chemistry, Inc., Boulder, CO (US)

(72) Inventor: Wayne E. Buschmann, Boulder, CO (US)

(73) Assignee: Clean Chemistry, Inc., Boulder, CO (US)

( * ) Notice: Subject to any disclaimer, the term of this patent is extended or adjusted under 35 U.S.C. 154(b) by 596 days.

(21) Appl. No.: 15/601,350

(22) Filed: May 22, 2017

(65) Prior Publication Data

US 2017/0335515 A1 Nov. 23, 2017

Related U.S. Application Data

(63) Continuation-in-part of application No. 15/371,872, filed on Dec. 7, 2016, now abandoned.
(Continued)

(51) Int. Cl.
*D21C 9/16* (2006.01)
*D21C 9/12* (2006.01)
(Continued)

(52) U.S. Cl.
CPC ..... *D21C 9/163* (2013.01); *D21C 9/1042* (2013.01); *D21C 9/1057* (2013.01); *D21C 9/123* (2013.01);
(Continued)

(58) Field of Classification Search
CPC ..... D21C 9/166
See application file for complete search history.

(56) References Cited

U.S. PATENT DOCUMENTS 3,719,552 A 3/1973 Farley
3,925,234 A 12/1975 Hachmann et al.
(Continued)

FOREIGN PATENT DOCUMENTS

CN 1142555 2/1997
EP 0480469 A3 4/1992
(Continued)

OTHER PUBLICATIONS

Gullichsen editor, Chemical Pulping 6A, 1999, Fapet Oy,A440, A441, and p. A616-A665. (Year: 1999).*
(Continued)

*Primary Examiner* — Anthony Calandra
(74) *Attorney, Agent, or Firm* — Snell & Wilmer L.L.P.

(57) ABSTRACT

In some embodiments, a method may include treating pulp. The method may include contacting a wood pulp with a singlet oxygen source. The method may include contacting the wood pulp with an alkaline peroxide source. The singlet oxygen source may include a peracetate oxidant solution and generating a reactive oxygen species. The peracetate oxidant solution may include peracetate anions and a peracid. In some embodiments, the peracetate solution may include a pH from about pH 10 to about pH 12. In some embodiments, the peracetate solution has a molar ratio of peracetate anions to peracid ranging from about 60:1 to about 6000:1. In some embodiments, the peracetate solution has a molar ratio of peracetate to hydrogen peroxide of greater than about 16:1. The peracetate oxidant solution may provide enhanced treatment methods of bleaching, brightening, and delignifying pulp fibers involving the use of peracetate oxidant solutions.

25 Claims, 4 Drawing Sheets

Related U.S. Application Data

(60) Provisional application No. 62/263,900, filed on Dec. 7, 2015.

(51) Int. Cl.
*D21C 9/147* (2006.01)
*D21C 11/00* (2006.01)
*D21C 9/10* (2006.01)

(52) U.S. Cl.
CPC ..... *D21C 9/147* (2013.01); *D21C 9/16* (2013.01); *D21C 9/166* (2013.01); *D21C 11/0007* (2013.01)

(56) References Cited

U.S. PATENT DOCUMENTS

| | | | |
|---|---|---|---|
| 4,055,505 | A | 10/1977 | Gray |
| 4,076,621 | A | 2/1978 | Hardison |
| 4,348,256 | A | 9/1982 | Bergstrom, Jr. et al. |
| 4,393,037 | A | 7/1983 | Delaney et al. |
| 4,576,609 | A | 3/1986 | Hageman |
| 4,673,473 | A | 6/1987 | Ang et al. |
| 4,722,773 | A | 2/1988 | Plowman et al. |
| 4,952,276 | A | 8/1990 | Gidlund |
| 4,966,706 | A | 10/1990 | Gregor |
| 5,053,142 | A | 10/1991 | Sorensen et al. |
| 5,246,543 | A | 9/1993 | Meier et al. |
| 5,387,317 | A | 2/1995 | Parthasarathy et al. |
| 5,424,032 | A | 6/1995 | Christensen et al. |
| 5,431,781 | A | 7/1995 | Walsh |
| 5,472,619 | A | 12/1995 | Holzhauer et al. |
| 5,494,588 | A | 2/1996 | LaZonby |
| 5,565,073 | A | 10/1996 | Fraser et al. |
| 5,683,724 | A | 11/1997 | Hei et al. |
| 5,770,035 | A | 6/1998 | Faita |
| 5,785,812 | A | 7/1998 | Linsten et al. |
| 5,817,240 | A | 10/1998 | Miller et al. |
| 6,007,678 | A | 12/1999 | Linsten et al. |
| 6,015,536 | A | 1/2000 | Lokkesmoe et al. |
| 6,126,782 | A | 10/2000 | Liden et al. |
| 6,183,623 | B1 | 2/2001 | Cisar et al. |
| 6,258,207 | B1 | 7/2001 | Pan |
| 6,387,238 | B1 | 5/2002 | Merk et al. |
| 6,569,286 | B1 | 5/2003 | Withenshaw et al. |
| 6,712,949 | B2 | 3/2004 | Gopal |
| 8,318,972 | B2 | 11/2012 | Buschmann et al. |
| 9,517,955 | B2 | 12/2016 | Buschmann |
| 9,517,956 | B2 | 12/2016 | Buschmann |
| 9,551,076 | B2 | 1/2017 | Buschmann |
| 10,259,729 | B2 | 4/2019 | Buschmann |
| 10,472,265 | B2 | 11/2019 | Buschmann |
| 10,501,346 | B2 | 12/2019 | Buschmann |
| 10,577,698 | B2 | 3/2020 | Buschmann |
| 10,611,656 | B2 | 4/2020 | Buschmann |
| 2001/0050234 | A1 | 12/2001 | Shiepe |
| 2002/0153262 | A1 | 10/2002 | Uno et al. |
| 2003/0019757 | A1 | 1/2003 | Vetrovec |
| 2003/0019758 | A1 | 1/2003 | Gopal |
| 2003/0024054 | A1 | 2/2003 | Burns |
| 2004/0112555 | A1 | 6/2004 | Tolan et al. |
| 2004/0134857 | A1 | 7/2004 | Huling et al. |
| 2004/0200588 | A1 | 10/2004 | Walker |
| 2005/0183949 | A1 | 8/2005 | Daly |
| 2006/0207734 | A1 | 9/2006 | Day |
| 2007/0074975 | A1 | 4/2007 | Buschmann et al. |
| 2007/0212594 | A1 | 9/2007 | Takasu et al. |
| 2007/0243449 | A1 | 10/2007 | Sotomura et al. |
| 2009/0012346 | A1 | 1/2009 | Al Nashef et al. |
| 2009/0090478 | A1* | 4/2009 | Hollomon ..... D21C 9/147 162/65 |
| 2009/0152123 | A1 | 6/2009 | Butler et al. |
| 2009/0285738 | A1 | 11/2009 | Winter et al. |
| 2009/0314652 | A1 | 12/2009 | Buschmann et al. |
| 2010/0078331 | A1 | 4/2010 | Scherson et al. |
| 2010/0160449 | A1 | 6/2010 | Rovison, Jr. et al. |
| 2010/0176066 | A1 | 7/2010 | Budde |
| 2010/0179368 | A1 | 7/2010 | Conrad |
| 2011/0017066 | A1 | 1/2011 | Takeuchi et al. |
| 2011/0024361 | A1 | 2/2011 | Schwartzel et al. |
| 2011/0123642 | A1 | 5/2011 | Wilmotte |
| 2011/0232853 | A1 | 9/2011 | Yin |
| 2012/0067532 | A1 | 3/2012 | Lee |
| 2012/0091069 | A1 | 4/2012 | Fischmann |
| 2012/0108878 | A1 | 5/2012 | Conrad |
| 2012/0145643 | A1 | 6/2012 | Pandya |
| 2012/0240647 | A1 | 9/2012 | Montemurro |
| 2012/0267315 | A1 | 10/2012 | Soane et al. |
| 2012/0322873 | A1 | 12/2012 | Atkins et al. |
| 2013/0259743 | A1 | 10/2013 | Keasler et al. |
| 2013/0264293 | A1 | 10/2013 | Keasler et al. |
| 2014/0069821 | A1 | 3/2014 | Marcin et al. |
| 2014/0072653 | A1 | 3/2014 | Buschmann |
| 2014/0131217 | A1 | 5/2014 | Buschmann |
| 2014/0131259 | A1 | 5/2014 | Goldblatt |
| 2014/0197102 | A1 | 7/2014 | Van Der Wal et al. |
| 2014/0205777 | A1 | 7/2014 | Hawkins et al. |
| 2014/0238626 | A1 | 8/2014 | Tsuji et al. |
| 2014/0374104 | A1 | 12/2014 | Seth |
| 2016/0068417 | A1 | 3/2016 | Buschmann |
| 2016/0297697 | A1 | 10/2016 | Buschmann |
| 2016/0318778 | A1 | 11/2016 | Buschmann |
| 2017/0051417 | A1 | 2/2017 | Buschmann |
| 2017/0107128 | A1 | 4/2017 | Buschmann |
| 2017/0114468 | A1 | 4/2017 | Buschmann |
| 2017/0158537 | A1 | 6/2017 | Buschmann |
| 2017/0159237 | A1 | 6/2017 | Buschmann |

FOREIGN PATENT DOCUMENTS

| | | | |
|---|---|---|---|
| WO | 9412721 | A1 | 6/1994 |
| WO | 9739179 | A1 | 10/1997 |
| WO | 1999032710 | | 7/1999 |
| WO | 2000069778 | | 11/2000 |
| WO | 2008056025 | A2 | 5/2008 |
| WO | 2010059459 | | 5/2010 |
| WO | 2012166997 | | 12/2012 |
| WO | 2013060700 | A1 | 5/2013 |
| WO | 2013064484 | | 5/2013 |
| WO | 9402423 | A1 | 2/2014 |
| WO | 2014039929 | | 3/2014 |
| WO | 2014100828 | | 6/2014 |
| WO | 2016037149 | | 3/2016 |
| WO | 2016154531 | | 9/2016 |
| WO | 2017100284 | | 6/2017 |
| WO | 2017100299 | | 6/2017 |
| WO | 2018106285 | A1 | 6/2018 |

OTHER PUBLICATIONS

Hill et al., Part 1: Peracetic Acid—An effective alternative for Chlorine compound Free Delignification of Kraft Pulp, 1992, Pulping Conference, p. 1219-1230. (Year: 1992).*

Szabo et al., Utilization of NaClO and H2O2 as Source of the Singlet Oxygen for the Environmental Bleaching of Pulp, 1994, Cellulose Chem. Technol.28, p. 183-194 (Year: 1994).*

Suihko et al.; "A study of the microflora of some recycled fibre pulps, boards and kitchen rolls;" Journal of Applied Microbiology; 1997; 83; pp. 199-207.

Pedros et al.; "Chlorophyll fluorescence emission spectrum inside a leaf"; The Royal Society of Chemistry and Owner Societies; 2008; No. 7; pp. 498-502.

Coyle et al.; "Peracetic Acid as an Alternative Disinfection Technology for Wet Weather Flows"; Water Environment Research; Aug. 2014; pp. 687-697.

Smook; "Chapter 14: Secondary Fiber"; Handbook for Pulp & Papers Technologists; Angus Wilde Publications; 2001; pp. 209-219.

CC15—Suslow, T. "Oxidation-Reduction Potential (ORP) for Water Disinfection Monitoring, Control, and Documentation" Univ. California Publication 8149 http://anrcatalog.ucdavis.edu, Copyright 2004.

(56) References Cited

OTHER PUBLICATIONS

Co-Pending U.S. Appl. No. 15/601,350 entitled, "Methods of Pulp Fiber Treatment" to Buschmann filed May 22, 2017.
Co-Pending U.S. Appl. No. 15/658,709 entitled, "Methods of Optical Brightening Agent Removal" to Buschmann filed Jul. 25, 2017.
CC16—L.D. Shackford, "A Comparison of Pulping and Bleaching of Kraft Softwood and Eucalyptus Pulps;" 36th International Pulp and Paper Congress and Exhibition; Oct. 13-16, 2003, Sao Paulo, Brazil.
Notice of Allowance for U.S. Appl. No. 14/122,185 dated Oct. 13, 2016.
Notice of Allowance for U.S. Appl. No. 14/020,828 dated Aug. 11, 2016.
CC06—International Preliminary Report on Patentability for PCT/US2013/058650 dated Jan. 29, 2014.
CC07—Australian Examination Report No. 1 for 2013312249 dated Mar. 17, 2017.
CC08—Second Office Action for Chinese Application No. 2013800580496 dated Sep. 18, 2016.
CC09—Extended European Search Report for European Application No. EP 13 83 4576 dated Oct. 4, 2016.
Notice of Allowance for U.S. Appl. No. 15/206,901 dated Aug. 17, 2016.
Restriction for U.S. Appl. No. 14/846,123 dated Sep. 7, 2017.
CC10—International Preliminary Report on Patentability for PCT/US2015/048722 dated Feb. 8, 2016.
CC11—International Preliminary Report on Patentability for PCT/US2016/024207 dated Sep. 26, 2017.
CC12—International Search Report for PCT/US2016/065326 dated Feb. 24, 2017.
Non-Final Office Action for U.S. Appl. No. 15/371,872 dated Oct. 12, 2017.
CC13—International Search Report for PCT/US2016/065345 dated Feb. 17, 2017.
CC14—International Search Report for PCT/US2017/033824 dated Aug. 29, 2017.
CC01—International Search Report for PCT/US2012/040325 dated Feb. 1, 2013.
Non-Final Office Action for U.S. Appl. No. 14/122,185 dated Oct. 28, 2015.
Final Office Action for U.S. Appl. No. 14/122,185 dated Jul. 28, 2016.
Non-Final Office Action for U.S. Appl. No. 14/020,828 dated Jan. 20, 2016.
Notice of Allowance for U.S. Appl. No. 14/020,828 dated Mar. 30, 2016.
CCO2—International Search Report for PCT/US2013/058650 dated Jan. 29, 2014.
CC03—First Office Action for Chinese Application No. 2013800580496 dated Feb. 4, 2016.
CC05—Supplementary Partial European Search Report for European Application No. EP 13 83 4576 dated May 10, 2016.
CC04—International Search Report for PCT/US2015/048722 dated Feb. 8, 2016.
Verween et al.; "Comparative toxicity of chlorine and peracetic acid in the biofouling control of Mytilopsis leucophaeata and Dreissena polymorpha embryos"; International Biodeterioration & Biodegradation; Jun. 1, 2009; vol. 63, No. 4; pp. 523-528.
Xu et al.; "Isotope and surface preparation effects on alkaline dioxygen reduction at carbon electrodes"; J. Electrochemical Chemistry 410; 1996; pp. 235-242.
Szabo et al., Utilization of NaClO and H2O2 as Source of the Singlet Oxygen for the Environmental Bleaching of Pulp, 1994, Cellulose Chem. Technol., 28, 183-194.

* cited by examiner

METHODS OF PULP FIBER TREATMENT

PRIORITY CLAIM

This application is a continuation-in-part of U.S. patent application Ser. No. 15/371,872 entitled "METHODS OF PULP FIBER TREATMENT" filed on Dec. 7, 2016, which claims priority to U.S. Provisional Patent Application No. 62/263,900 entitled "METHODS OF MICROBIAL CONTROL" filed on Dec. 7, 2015, all of which is incorporated by reference herein.

BACKGROUND OF THE INVENTION

1. Field of the Invention

The present disclosure generally relates to pulp fiber treatment using peracetate oxidant solutions. The disclosure more particularly relates to methods of bleaching, brightening, and delignifying pulp fibers involving the use of peracetate oxidant solutions to provide singlet oxygen.

2. Description of the Relevant Art

A variety of methods have been developed for delignification of wood pulp fibers after the initial pulping to achieve brighter unbleached grades and bleachable grades (e.g., kappa number 10-15). Common delignification methods include reductive methods (e.g., extended or enhanced sulfide digestion), oxidative methods (e.g., oxygen delignification, alkaline hydrogen peroxide extraction and combinations), and enzymatic methods (e.g., zylanase).

Bleaching of pulp (wood and non-wood fibers) is commonly done by elemental chlorine free (ECF) processes and totally chlorine free (TCF) processes. The ECF processes are currently more economic and common than TCF in large pulp and paper mills for reaching white fiber grades of greater than about 80% ISO brightness. ECF bleaching commonly involves several chlorine dioxide stages with washing and extraction stages in between. TCF processes may incorporate extended delignification stages and alternative bleaching chemicals including multiple alkaline hydrogen peroxide stages, ozone and peracetic acid to achieve brighter fiber grades.

Singlet oxygen is well suited for oxidation of phenols, chlorinated phenols and similar electron-rich phenolic materials including lignin. Lignin generally consists of cross-linked polyphenolic materials created by enzyme-mediated polymerization of coniferyl, sinapyl and p-coumaryl alcohols. Singlet oxygen (which is not a radical) is relatively selective towards phenol oxidation and has little direct impact on cellulose fibers. In contrast, ozone and radicals including elemental chlorine, hydroxyl radical, hydroperoxyl radical, superoxide and even triplet oxygen are more reactive towards cellulose in conventional delignification and bleaching processes.

The selectivity of singlet oxygen towards the oxidation and break down of lignin and non-cellulose materials avoids non-selective reactions that break down cellulose by radical-based or radical-forming oxidants including gaseous chlorine, chlorine dioxide and ozone. Reactive oxygen radical species such as superoxide and peroxyl radicals are known to form during higher pressure and temperature oxygen delignification processes and can cause damage to cellulose fibers. It is generally known in the art that cellulose fibers are susceptible to damage by radical species, which reduces fiber yield and fiber strength. The addition of alkali to oxygen delignification and hydrogen peroxide extraction is common practice to increase the oxidation and extraction rates of lignin from cellulose fiber. However, excessive alkali concentrations or exposure times will also cause damage to cellulose fiber.

The rate of delignification also impacts the preservation of pulp fiber yield, strength and quality. Shorter exposure time of fiber to oxidizing and alkaline conditions may reduce the amount of non-selective breakdown of cellulose fiber. For example, an oxygen delignification process for wood pulp is typically 30 to 60 minutes retention time to achieve about 20-60% kappa reduction depending on the oxygen stage design, operating conditions and wood species. In comparison, the use of the peracetate oxidant formulation may achieve the same kappa reduction performance in 1 to 20 minutes contact time or retention time depending on the wood species, process design and operating conditions. Shorter retention times may also increase pulp throughput or decrease the size and cost of equipment for a delignification process.

Studies of singlet oxygen oxidation of phenols has historically been conducted using photocatalytic methods to generate singlet oxygen in-situ. This method often involves irradiation of a solution containing a photosensitive dye (e.g., rose bengal, methylene blue) which transfers its photo-excited state energy to dissolved oxygen. Relying on a dye mediated photooxidation process is not practical for pulp delignification due to optically opaque pulp mixtures and the rapid breakdown of photosensitive dyes by singlet oxygen and other ROS.

Polychlorinated phenols are one of the major absorbable organic halogens (AOX) that may be discharged in pulp bleaching effluents. Dioxins, furans and other halogenated organic materials are also formed during chlorine and chlorine dioxide bleaching and are included in the AOX category. AOX formation is highly dependent on the lignin content (proportional to kappa number) of the pulp prior to bleaching. The more reduction in kappa number prior to bleaching the less AOX formation potential. The ROS-generating peracetate formulation has the ability to reduce kappa number (lignin content) significantly.

Furthermore, there are few economically viable options for delignification and bleaching of wood and non-wood pulps on smaller scales than those feasible for traditional pulp and kraft pulp mills. Oxygen delignification has very high capital costs and significant operating and maintenance costs. Digesters for reductive, hydrolytic and enzymatic methods have moderate capital costs but may occupy a large footprint and have long retention times. Adding new bleaching plants to existing facilities is often not economically feasible, especially for smaller capacity facilities (e.g., less than 1000 tons per day product). Options for delignification and bleaching which are lower cost and simpler to implement or retro-fit into a pulp treatment process will be beneficial to smaller and existing fiber lines.

Fiber products, including fiber board and molded fiber products, produced from pulps of various types used in food packaging and compostables are generally unbleached if gaseous chlorine, chlorine bleach and chlorine dioxide are excluded from the processing. Producing these products with brightened (e.g., 65% ISO brightness or greater) or near-white grades of fiber without the use of traditional bleaching lines is desirable.

The use of elevated concentrations of chlorine dioxide in water treatment is particularly hazardous. For example, the head space of a tank containing water with 20 mg/L chlorine dioxide will slowly equilibrate to a head space concentration of 807 mg/m$^3$ at 25° C. and 1 atm according to Henry's law calculations. Pulp bleaching operations using chlorine dioxide at several hundred to several thousand mg/L concentrations and elevated temperatures pose severe exposure hazards over large areas if not properly contained. Gases are more difficult to contain than liquid solutions with low vapor pressures. Chlorine dioxide is also an explosive gas and can undergo explosive decomposition above 10% v/v chlorine dioxide in air. Above 14% explosions are violent. Explosive vapor concentrations can be achieved in pipes that are only partially filled with moderately concentrated chlorine dioxide solutions.

Water used in chlorine and chlorine dioxide bleaching stages is not compatible with recovery boilers and other process equipment outside of the bleaching circuit due to the highly corrosive chloride and chlorate content. Chlorides would accumulate in closed loop processes in a pulp mill used upstream of the bleaching circuit causing corrosion damage to conventional process equipment. Therefore, the water from bleaching stages, which also contains the majority of AOX emissions, must be segregated, treated and disposed of as waste water. The peracetate oxidant formulation contains no chloride content and its organic carbon content can be combusted in the recovery boilers. Each chlorine or chlorine dioxide bleaching stage that is replaced or reduced by using the peracetate oxidant formulation upstream of the bleaching circuit represents a reduction in the waste water stream, reduction in AOX and reduced financial and environmental costs of treatment and disposal or discharge.

Corrosivity of radical compounds used in the delignification, brightening and bleaching stages is another issue, especially when these compounds come in contact with various process materials such as steel, copper and brass alloys. These compounds used in processes where elevated temperatures and turbulence are present in the liquid phase should ideally have low vapor pressures to minimize vapor phase corrosion of surrounding equipment and structures. Compounds that are gases in their native form are the most volatile and present the greatest corrosion and occupational exposure hazards, including chlorine, chlorine dioxide and ozone.

There is a need for improved oxidation and extraction of colored materials and color-forming materials from pulp fibers for brightening and bleaching purposes. It is desirable to find an efficient and cost effective method of treating pulp without the use of halogen-containing bleaching chemicals. It is also desirable to conduct bleaching of pulp by new methods to achieve the desired brightness which are less damaging to pulp fiber and extract less mass of pulp during bleaching to increase pulp yield relative to conventional pulp bleaching methods. The reactive oxygen species (ROS) generating peracetate formulation of the present invention may be used for decreasing the use of halogen-containing oxidants and thus TOX and AOX formation. Use of the peracetate formulation in pulp processing may reduce pollution, reduce waste water effluent and enhance processes for extracting lignin from cellulosic fiber for the recovery of lignin from the black liquor or spent oxidant liquor.

SUMMARY

In some embodiments, methods described herein may use ROS formulations, which generate singlet oxygen as the primary ROS, in bleaching sequences to brighten and whiten pulp fiber such that chlorine and chlorine dioxide use may be significantly reduced to increase pulp yield and preserve fiber strength.

In some embodiments, methods described herein using ROS formulations in bleaching sequences enable the brightening and whitening of pulp without removing as much material from pulp as conventional ECF bleaching sequences (e.g. D E D D bleach sequence).

In an embodiment, the methods described herein provide a method of bleaching pulp using a singlet oxygen stage followed by an alkaline peroxide stage. Peroxide may be in the form of hydrogen peroxide, sodium peroxide, potassium peroxide or calcium peroxide. Peroxide may be in the form of a percarbonate, a perborate or a persulfate.

In an embodiment, the methods described herein provide a method of bleaching pulp using a singlet oxygen stage followed by an alkaline peroxide stage at least once during a bleach sequence. The alkaline hydrogen peroxide stage removes the remaining lignin and other materials impacted by the singlet oxygen stage, but not extracted into the singlet oxygen liquor. Without an alkaline peroxide stage for extraction after a singlet oxygen stage the oxidant demand for a subsequent chlorine dioxide stage is not significantly reduced.

Singlet oxygen can rapidly oxidize and extract lignin and non-lignin colored materials from pulp while making residual materials that remain in the pulp more readily extractable in subsequent bleaching stages. Residual materials may be bound or unbound to pulp fiber structures including hemicellulose structures and cellulose structures. Subsequent bleaching stages may include alkaline hydrogen peroxide, chlorine dioxide, ozone and peracetic acid. In one embodiment, a singlet oxygen stage, 1O, is followed by an alkaline hydrogen peroxide stage, P, to significantly increase brightness and reduce the amount of $ClO_2$ required in an ECF bleaching sequence. A chelating wash stage, Q, may be used just prior to an alkaline hydrogen peroxide stage, but after the 1O stage. A chelating agent used in Q stage may include ethylenediaminetetraacetic acid (EDTA) and diethylenetriaminepentaacetic acid (DTPA). An alkaline hydrogen peroxide stage may include the use of a magnesium salt such as magnesium sulfate. An alkaline hydrogen peroxide stage may be followed by a singlet oxygen stage. A chlorine dioxide stage, D, may be conducted after an alkaline hydrogen peroxide stage. A chlorine dioxide stage may be followed by subsequent chlorine dioxide, peracetic acid, Paa, alkaline extraction, E, and/or alkaline hydrogen peroxide stages. An ozone stage, Z, may be used before or after any such stages listed above.

In one embodiment a bleaching sequence is 1O P, which may be followed by additional bleaching stages. In other embodiments the bleaching sequence may be chosen from the following examples (these examples are not meant to be limiting):

1O P;
1O Q P;
1O P 1O P;
1O P E;
1O P D P;
1O Q P D P;
1O Q P 1O P;
1O P D D;
1O P D P D;
1O P D E D;
1O P 1O P D P;
1O Paa P D P;
1O P D Paa P;

1O P Z E D P;

Z E 1O P; and

Z E 1O P D P.

A first singlet oxygen stage may be conducted after a pulping process including mechanical, chemical, sulfide digestion, steam explosion and enzymatic pulping processes or a combination of pulping processes. A first singlet oxygen stage may be conducted after a delignification stage including oxygen delignification and peroxide-reinforced oxygen delignification.

In a preferred embodiment a bleaching sequence may be singlet oxygen, followed by chelation, followed by alkaline hydrogen peroxide, where the bleaching sequence is represented as 1O Q P. This bleaching sequence may achieve pulp brightness of 60% ISO or greater without further bleaching steps.

In a preferred embodiment a bleaching sequence may be singlet oxygen, followed by chelation, followed by alkaline hydrogen peroxide, followed by chlorine dioxide, followed by alkaline hydrogen peroxide, where the bleaching sequence is represented as 1O Q P D P. This bleaching sequence may achieve pulp brightness of 80% ISO or greater without further bleaching steps. This bleaching sequence may preferably achieve pulp brightness of 85% ISO or greater without further bleaching steps.

In another embodiment a bleaching sequence may be singlet oxygen, followed by chelation, followed by alkaline hydrogen peroxide, followed by singlet oxygen, followed by alkaline hydrogen peroxide, where the bleaching sequence is represented as 1O Q P 1O P. This bleaching sequence may achieve pulp brightness of 60% ISO or greater, 70% ISO or greater, or 80% ISO or greater without further bleaching steps. This bleaching sequence may preferably achieve pulp brightness of 85% ISO or greater without further bleaching steps.

In an embodiment, a method may include rapidly optimizing a bleach sequence by monitoring and/or evaluating absorbance spectra of bleaching liquors, fiber brightness and/or fiber viscosity. Evaluating the amount and type of materials extracted during a bleach sequence or individual stages within the sequence is rapidly conducted by measuring the UV-Vis absorbance spectrum of bleaching liquors. The amount of lignin and other oxidizable materials removed from or remaining in pulp can be rapidly evaluated with kappa number measurements. The impact of a bleach sequence or individual stages within the sequence on fiber brightening may be rapidly evaluated and quantified by brightness measurements. The impact of a bleach sequence or individual stages within the sequence on chemical impacts on the cellulose structure of the pulp fiber may be rapidly evaluated and quantified by viscosity measurements. A combination of these analysis methods provides a method for preliminary evaluation of bleach sequence conditions.

In an embodiment, a method of using a singlet oxygen stage followed by an alkaline peroxide stage to achieve a pulp brightness of about 60% ISO or greater.

In an embodiment, a method of using a singlet oxygen stage followed by an alkaline peroxide stage to reduce the amount of chlorine dioxide used in a bleach sequence by up to about 97% to achieve a pulp brightness of about 60% ISO or greater.

In an embodiment, a method of using a singlet oxygen stage followed by an alkaline peroxide stage to reduce the amount of chlorine dioxide used in a bleach sequence by up to about 95% to achieve a pulp brightness of about 80% ISO or greater.

In an embodiment, a method of using more than one pair of singlet oxygen and alkaline hydrogen peroxide stages in a bleach sequence to achieve a pulp brightness of about 60% ISO or greater. It was found that using two or more singlet oxygen stages paired with alkaline peroxide stages used sequentially could provide significant brightness gains without the use of chlorine dioxide.

In an embodiment, the use of singlet oxygen and alkaline hydrogen peroxide stages together can provide a new method for totally chlorine free (TCF) bleaching of pulp. In an embodiment, a preferred method may include a singlet oxygen stage followed by a chelating wash stage followed by an alkaline peroxide stage may achieve pulp brightness of about 60% ISO or greater. This bleaching sequence may preferably achieve pulp brightness of 70% ISO or greater without further bleaching steps.

In an embodiment, a method of using more than one pair of singlet oxygen and alkaline hydrogen peroxide stages in a bleach sequence to achieve a pulp brightness of about 80% ISO or greater. This bleaching sequence may preferably achieve pulp brightness of 85% ISO or greater without further bleaching steps.

In an embodiment, the method of using at least one singlet oxygen stage in a bleach plant wherein a singlet oxygen stage and an alkaline peroxide stage are used in a bleach plant.

In an embodiment, the method of using at least one singlet oxygen stage in a pulp plant wherein a singlet oxygen stage and an alkaline peroxide stage are used in a pulp plant.

The sodium peracetate formulation comprising the ROS formulation is chlorine-free and its byproducts in pulp liquors are compatible with recovery boilers for closed-loop recycle processes. A bleach sequence using at least one singlet oxygen stage may be conducted fully within a bleach plant. A bleach sequence using at least one singlet oxygen stage may be conducted partly in a pulp plant where the bleach stages prior to a chlorine dioxide or chlorine stage are compatible with a pulp plant process. A bleach sequence using at least one singlet oxygen stage may be conducted fully in a pulp plant where chlorine dioxide and chlorine are not used in a bleach sequence.

In an embodiment, a method of using at least one singlet oxygen stage to reduce bleach plant water consumption. Reducing the amount of chlorine dioxide or chlorine used and the number of steps in which they are used in a bleach sequence reduces the amount of water used in a bleach plant. This reduces the amount of water used in the chlorine dioxide or chlorine treatment steps and reduces the amount of water used to wash the pulp after chlorine dioxide or chlorine steps.

In an embodiment, a method may include using at least one singlet oxygen stage to reduce the quantity of bleach plant water effluent. Reducing bleach plant water consumption reduces the amount of effluent from a bleach plant that requires treatment or disposal. Bleach plant water effluent is not compatible with recovery boilers for closed-loop recycle processes.

In an embodiment, a method of using singlet oxygen in a bleach sequence to preserve pulp fiber viscosity. Singlet oxygen provided by the ROS formulation does not have a significant negative impact on the pulp fiber's cellulosic structure. Under natural pH or pulp pH conditions in a mill fiber line (e.g., pH 6.0-10.8) the singlet oxygen ROS formulation can have little to no impact on pulp viscosity in a bleach sequence. A result of dramatically reducing $ClO_2$ use in a bleach sequence is that it has greatly reduced or minimal impact on viscosity. Therefore, a combination of singlet oxygen and low $ClO_2$ use can better preserve the viscosity of pulp fiber, which results in higher strength fiber after bleaching.

In an embodiment, a method of using singlet oxygen in a bleach sequence to increase pulp yield. Using singlet oxygen provided by a ROS formulation in a bleach sequence increased pulp brightness with significantly less corresponding reduction in kappa number than conventionally bleached pulps (e.g., ECF bleach sequences that achieve brightness of 70% ISO or greater). Pulp yield has been correlated with kappa number in the pulp industry (for example see L. D. Shackford, "A Comparison of Pulping and Bleaching of Kraft Softwood and Eucalyptus Pulps;" $36^{th}$ International Pulp and Paper Congress and Exhibition; Oct. 13-16, 2003, Sao Paulo, Brazil, incorporated by reference herein) and the correlation is generally consistent for each wood species. For example, hardwood species like spruce and birch bleached to a brightness of 85% ISO typically have a kappa number of about 1, a common "market pulp" grade. It was demonstrated using methods described herein that incorporating a singlet oxygen stage in a hardwood pulp bleach sequence could provide a final brightness of 85% ISO with a kappa number of about 4.4.

Increasing the amount of singlet oxygen used in the bleaching sequence was found to increase the final kappa number of the pulp after the entire bleaching sequence. The singlet oxygen chemistry provided by the ROS formulation modifies the pulp in a manner that serves to protect non-colored materials in the pulp from oxidation and extraction in subsequent bleaching stages.

Types of fiber treated in this invention include wood pulp and other fibers used in paper, packaging and molded fiber products including bamboo, eucalyptus, wheat straw, rice, bagasse, palm, flax and other plant-based sources. The lignocellulosic pulp employed in the present invention can be prepared from any lignocellulose-containing material derived from natural sources such as, but not limited to, hardwood, softwood, gum, straw, bagasse and/or bamboo by various chemical, semichemical, thermal, mechanical or combination pulping processes. Chemical and semichemical pulping processes include, but not limited to kraft, modified kraft, kraft with addition of sulfur and/or anthraquinone, and sulfite. Mechanical pulping processes include, but not limited to stone groundwood, pressurized groundwood, refiner mechanical, thermo-refiner mechanical, pressure refined mechanical, thermo-mechanical, pressure/pressure thermo-mechanical, chemi-refiner-mechanical, chemi-thermo-mechanical, thermo-chemi-mechanical, thermo-mechanical-chemi, and long fiber chemi-mechanical pulp. Handbook for Pulp and Paper Technologist, ed. G. A. Smook (Atlanta, Ga., TAPPI Press, 1989) describes both chemical and mechanical pulping.

In some embodiments, the correlations between kappa number and brightness have been disrupted. The current methods preserve pulp viscosity (a strength parameter). The current methods reduce $ClO_2$ use dramatically and quantifiably. The current methods reinforce or enhance $ClO_2$ performance (measurable by UV). In some embodiments, some or all of this may be accomplished by designing bleach sequences. Previous methods did not include alkaline peroxide step (previous methods only replaced peroxide with singlet oxygen compositions in a $ClO_2$ bleach sequence).

BRIEF DESCRIPTION OF THE DRAWINGS

Advantages of the present invention may become apparent to those skilled in the art with the benefit of the following detailed description of the preferred embodiments and upon reference to the accompanying drawings.

Figure 1:
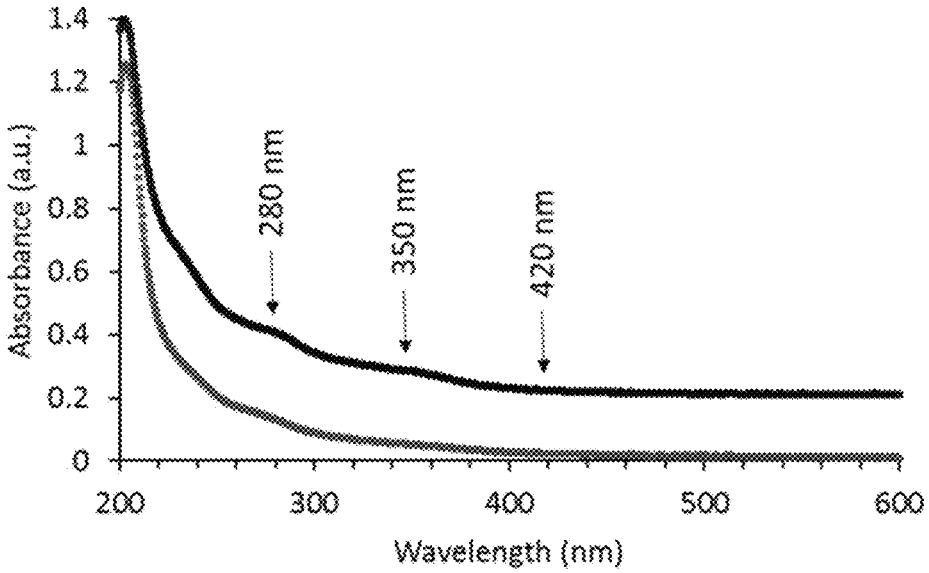
FIG. 1 depicts examples of UV-Vis absorption spectra of alkaline hydrogen peroxide liquors from hardwood (upper trace) and softwood (lower trace) pulps.

While the invention is susceptible to various modifications and alternative forms, specific embodiments thereof are shown by way of example in the drawings and may herein be described in detail. The drawings may not be to scale. It should be understood, however, that the drawings and detailed description thereto are not intended to limit the invention to the form disclosed, but on the contrary, the intention is to cover all modifications, equivalents and alternatives falling within the spirit and scope of the present invention as defined by the appended claims.

The headings used herein are for organizational purposes only and are not meant to be used to limit the scope of the description. As used throughout this application, the word "may" is used in a permissive sense (i.e., meaning having the potential to), rather than the mandatory sense (i.e., meaning must). The words "include," "including," and "includes" indicate open-ended relationships and therefore mean including, but not limited to. Similarly, the words "have," "having," and "has" also indicated open-ended relationships, and thus mean having, but not limited to. The terms "first," "second," "third," and so forth as used herein are used as labels for nouns that they precede, and do not imply any type of ordering (e.g., spatial, temporal, logical, etc.) unless such an ordering is otherwise explicitly indicated. Similarly, a "second" feature does not require that a "first" feature be implemented prior to the "second" feature, unless otherwise specified.

Various components may be described as "configured to" perform a task or tasks. In such contexts, "configured to" is a broad recitation generally meaning "having structure that" performs the task or tasks during operation. As such, the component can be configured to perform the task even when the component is not currently performing that task. In some contexts, "configured to" may be a broad recitation of structure generally meaning "having a feature that" performs the task or tasks during operation. As such, the component can be configured to perform the task even when the component is not currently on.

Various components may be described as performing a task or tasks, for convenience in the description. Such descriptions should be interpreted as including the phrase "configured to." Reciting a component that is configured to perform one or more tasks is expressly intended not to invoke 35 U.S.C. § 112 paragraph (f), interpretation for that component.

The scope of the present disclosure includes any feature or combination of features disclosed herein (either explicitly or implicitly), or any generalization thereof, whether or not it mitigates any or all of the problems addressed herein. Accordingly, new claims may be formulated during prosecution of this application (or an application claiming priority thereto) to any such combination of features. Regarding the appended claims, features from dependent claims may be combined with those of the independent claims and features from respective independent claims may be combined in any appropriate manner and not merely in the specific combinations enumerated in the appended claims.

It is to be understood the present invention is not limited to particular devices or biological systems, which may, of course, vary. It is also to be understood that the terminology used herein is for describing embodiments only, and is not intended to be limiting. As used in this specification and the appended claims, the singular forms "a", "an", and "the" include singular and plural referents unless the content clearly dictates otherwise. Thus, for example, reference to "a linker" includes one or more linkers.

DETAILED DESCRIPTION

Definitions

Unless defined otherwise, all technical and scientific terms used herein have the same meaning as commonly understood by one of ordinary skill in the art.

The term "about" as used herein generally refers to a descriptor that modifies a quantifiable amount (unless otherwise defined herein or as a generally accepted term of art) by plus or minus ten percent.

The term "reactive oxygen species" as used herein generally refers to a species such as may include singlet oxygen ($^1O_2$), superoxide radical ($O_2.^-$), hydroperoxyl radical (HOO.), hydroxyl radical (HO.), acyloxy radical (RC(O)—O.), and other activated or modified forms of ozone (e.g., ozonides and hydrogen trioxide). Each of these ROS has its own oxidation potential, reactivity/compatibility profile, compatibility/selectivity and half-life.

The term "reactive species oxidant" as used herein generally refers to oxidant formulations containing or capable of evolving at least one reactive oxygen species and can evolve at least one reactive carbon species. Such reactive species enhance the oxidative or reductive performance of the precursor formulation constituents.

The term "pulp" as used herein generally refers to a suspension of cellulose fibers in water consisting of any lignocellulose-containing material derived from natural sources such as, but not limited to, hardwood, softwood, bamboo, eucalyptus, wheat straw, rice and other plant-based sources, straw, bagasse and/or bamboo and such pulp produced by various chemical, semichemical, thermal or mechanical pulping processes or a combination pulping processes.

The terms "delignifying" and "delignification" as used herein generally refers to removal of lignin from wood and non-wood fibers by mechanical, chemical or enzymatic means or a combination thereof the polymer lignin from wood.

The term "bleaching" as used herein generally refers to a chemical process used to whiten and purify pulp and the processing of wood to decrease the color of the pulp and to make it whiter.

The term "brightening" as used herein generally refers to increasing the reflectance and/or whiteness of fibers, which may be related to a reduction in kappa number and/or the oxidation and removal of colored materials or color-forming materials from pulp.

The term "pulp treatment process" as used herein generally refers at least one of pulping, delignification and bleaching.

The term "liquor" as used herein generally refers to black liquor, oxidant liquor, bleaching liquor, pulping liquor and wash liquor drained from the pulp during and/or after pulping, delignification and bleaching processes.

EMBODIMENTS

In some embodiments, the ROS formulation described herein, which generates singlet oxygen in significant quantities, has significant beneficial impacts on delignification, lignin extraction and bleaching of pulp. A singlet oxygen stage used at the beginning of a bleach sequence or used within a bleach sequence, when followed by an alkaline peroxide stage, significantly reduces the amount of chlorine dioxide ($ClO_2$) needed to achieve brighter and white grades of pulp. Singlet oxygen delignification may be used to increase the efficiency of lignin extraction and brightening at subsequent bleaching stages, including stages that are two, three or more steps after a singlet oxygen stage. The increased lignin extraction and brightening efficiency enabled by using the ROS formulation in a ECF bleach sequence enables the use of up to about 97% less $ClO_2$ to produce pulp brightness of about 60% ISO or greater. Elimination of $ClO_2$ from a bleach sequence may be enabled by employing more than one pair of singlet oxygen and alkaline peroxide stages in a bleaching sequence.

The use of singlet oxygen in a bleach sequence has several important impacts on pulp production performance, economics, operations and pollution prevention. In some embodiments, it may eliminate up to 97% $ClO_2$ use in an elemental chlorine free (ECF) bleach sequence to achieve pulp brightness of about 60% ISO or greater. It may eliminate the need for $ClO_2$ use by enabling more effective totally chlorine free (TCF) bleach sequences. It may increase pulp yield in proportion to maintaining higher kappa number of pulp during a bleach sequence. It may increase bleached fiber strength in proportion to maintaining higher viscosity of pulp fiber during a bleach sequence. It may produce brighter fiber grades without a conventional bleach plant. It may reduce absorbable organic halide (AOX) effluent in proportion to the reduction of $ClO_2$ use. It may reduce the amount of wastewater generated in a bleach plant for treatment and disposal. It may reduce corrosion in a bleach plant in proportion to the reduction of $ClO_2$ use. It may increase safety in a bleach plant by significantly reducing the amount of $ClO_2$ used in a process. It may reduce the amount of water used in a bleach plant. It may increase water recycling in a pulp mill with a bleach plant by conducting singlet oxygen and peroxide stages in the pulp plant.

The peracetate formulation comprising the reactive oxygen species (ROS) formulation described herein may generate singlet oxygen as its primary ROS. Singlet oxygen is particularly efficient at oxidizing aromatic rings and unsaturated hydrocarbons (alkenes or olefins), which dominate the structure of lignin or are produced during chemical pulping processes. Singlet oxygen oxidation may be selective towards unsaturated hydrocarbons and phenolic materials comprising lignin and, as a result, has low impact on cellulose fibers compared to less selective oxidants that may generate significant quantities of free radicals or are free radicals in their native form including alkaline hydrogen peroxide, ozone, chlorine dioxide, elemental chlorine, free chlorine and hydroxyl radicals.

Singlet oxygen provided by the ROS formulation described herein was found to impact lignin structures in a manner that provides rapid and extensive delignification and extraction of lignin from a variety of pulps including sulfate pulps and oxygen-delignified pulps having medium kappa numbers (e.g., 10-50 kappa number), but also degrades lignin structures in a way that allows for traditional chemical bleaching treatments to more efficiently and extensively extract and remove lignin and other colored materials from pulp prior to, during and after bleaching with $ClO_2$.

Delignification and brightening driven by the ROS formulation enables a significant reduction in the use of $ClO_2$ bleaching in a conventional ECF bleaching process to achieve brighter grades of pulp. Pulp brightness of about 60% ISO or greater can be achieved with up to about a 97% reduction of $ClO_2$ use relative to many conventional ECF bleach sequences. Pulp brightness of about 80% ISO or greater can be achieved with up to about a 95% reduction of $ClO_2$ use relative to many conventional ECF bleach sequences. Alternatively, $ClO_2$ may be eliminated from a bleach sequence to conduct TCF bleaching. The key to this ability is enabling the selective oxidation, damage and extraction of lignin, non-lignin colored materials and color-forming materials (e.g., hexenuronic acids, HexA) with singlet oxygen. These materials are generally composed of phenol structures, olefin structures, aromatic and non-aromatic hydrocarbons. Singlet oxygen can undergo [2+2] and [4+2] Diels-Alder type cycloadditions with olefins, phenols and other aromatic hydrocarbons efficiently. Singlet oxygen can also undergo "ene reactions" with alkenes or olefins. These singlet oxygen reaction mechanisms are relatively selective toward olefins, phenols and other aromatic hydrocarbons. Elevated temperature accelerates reaction rates considerably for these reactions leading to rapid delignification and oxidative degradation of phenolic materials while having little impact on cellulose fiber.

Free radical species (e.g., superoxide, hydroperoxyl, hydroxyl and alkoxyl radicals) are known to cause depolymerization of polysaccharides. Oxidative depolymerization of polysaccharides is known to be initiated by hydrogen abstraction by a free radical species leading to β-scission reactions and breakdown of polysaccharide chains. Highly alkaline conditions (e.g., pH 11 and greater) can also cause polysaccharide breakdown through base hydrolysis or alkaline hydrolysis of glycosidic bonds. Depolymerization causes a decrease in viscosity of polysaccharide solutions. Viscosity is the basis for one standard method of measuring the impact of chemical treatments on pulp fiber, which is composed of cellulosic structures made of polysaccharides.

Kappa number is generally a measure of the amount of materials in pulp that can be oxidized by permanganate and is proportional to lignin content, but can include non-lignin materials formed from hemicellulose materials during chemical pulping and oxygen delignification processes. Pulp bleaching removes residual lignin, but the use of strong bleaching chemicals such as chlorine, chlorine dioxide and ozone may also remove residual hemicellulose and cause non-selective oxidative degradation and loss of the cellulose fibers. Removal of lignin, hemicellulose and cellulose from pulp results in reduction of pulp yield relative to the initial mass of wood entering a pulp mill or bleach plant. Removal of less material from the pulp, as indicated by significantly higher kappa numbers associated with a given brightness, can increase pulp yield.

In an elemental chlorine free (ECF) bleaching sequence $ClO_2$ is commonly used to do a significant delignification step in a first bleaching stage, often designated as $D_0$. This delignification allows high brightness to be achieved more efficiently in subsequent bleaching stages, which are often designated as $D_1$ and $D_2$. An alkaline extraction stage is often used after $D_0$ and the bleach sequence may be finished with a hydrogen peroxide stage to provide additional brightening and reduce color reversion. This is a common ECF bleaching approach to produce bleached "market pulp" with a brightness of 85% ISO and a kappa number of about 1. The total amount of $ClO_2$ used in this sequence may range between about 45 to 90 lbs $ClO_2$ per oven dry ton of pulp depending on several factors including the pulp species, pulping and delignification methods used, kappa number prior to bleaching and bleaching process conditions.

The majority of $ClO_2$ (e.g., 60-90%) is used in a $D_0$ stage, which is also when the majority of absorbable organic halide (AOX) and AOX waste stream is produced. Some examples of toxic AOX byproducts from pulp bleaching include chlorophenols, chlorobenzenes, chlorofurans, chloroform and dioxins. Eliminating the $D_0$ stage by using singlet oxygen and hydrogen peroxide stages will eliminate the majority AOX waste stream.

Chlorine dioxide, its chlorinated precursors and byproducts (e.g., chlorite, chlorate) and chloride salt byproducts are not compatible with recovery boilers and other equipment in pulp plants where water and liquor materials are reused in closed-loop cycles. As a result, the use of chlorine and $ClO_2$ is limited to bleach plants where the bleach plant water effluent is a toxic waste stream.

In some embodiments, the use of a singlet oxygen stage followed by an alkaline hydrogen peroxide stage at least once in a bleaching sequence provides the ability to brighten fiber significantly without a conventional bleach plant. The use of the ROS formulation to deliver singlet oxygen in large quantities as a liquid ROS formulation into a pulping process creates an opportunity to add chemical brightening steps to an existing fiber line without the large capital costs needed to build conventional bleaching facilities.

In some embodiments, the ROS-generating peracetate formulation described herein may be used for delignification and extraction of materials from pulp fibers for brightening and bleaching purposes. It may also be used for extracting lignin from cellulosic fibers for the recovery of lignin from the black liquor or spent oxidant liquor.

It was discovered that the full potential of a singlet oxygen treatment of pulp is realized in subsequent treatment steps or bleaching stages. In some embodiments, singlet oxygen is effective at breaking down and extracting lignin and other materials from pulp in a selective manner that can have little to no derogatory impact on cellulose fibers. In some embodiments, singlet oxygen may damage lignin and other colored or color-forming materials in pulp in a way that allows an alkaline hydrogen peroxide treatment step to extract lignin and other colored or color-forming materials from pulp more efficiently than without the use of singlet oxygen.

In some embodiments, one preferred ROS-producing oxidant formulation is a peracetate solution. The peracetate solution may include generating an alkaline hydrogen peroxide solution from the combination of an alkali and a hydrogen peroxide concentrate, mixing the alkaline hydrogen peroxide solution with an acyl donor such that a peracetate solution concentrate is formed. In some embodiments, the peracetate solution may include peracetate anions and a peracid. In some embodiments, the peracetate solution may include a pH from about pH 10 to about pH 12. In some embodiments, the peracetate solution has a molar ratio of peracetate anions to peracid ranging from about 60:1 to about 6000:1. ROS-generating peracetate oxidant solutions may contain no hydrogen peroxide, and are produced on site and on demand at alkaline pH. The peracetate oxidant solution produces multiple ROS by itself and when placed into contaminated environments. In some embodiments, the ROS most important in peracetate oxidant solutions include singlet oxygen, superoxide radical, hydroperoxyl radical, acetyloxy radical and potentially other radical fragments. When a combination of these ROS are generated together in peracetate oxidant solutions they produce an oxidative-reductive potential (ORP) response in water that may exceed 900 mV (vs standard hydrogen electrode) around pH 7. These solutions may be more convenient and effective to use than other approaches. The dominant ROS may be selectively reactive such that they are effective in a variety of environments.

In some embodiments, a method may include making a reactive species formulation. The method may include providing an alkaline hydrogen peroxide solution. The method may include contacting the alkaline hydrogen peroxide solution with an acyl donor. A peracid concentrate may be produced by the contacting of the alkaline hydrogen peroxide with the acyl donor. The peracid concentrate may have a molar ratio of hydrogen peroxide to acyl donor reactive groups ranging from about 1:1.25 to about 1:4. The method may include maintaining the peracid concentrate pH value in a range from about pH 10 to about pH 12. Singlet oxygen sources and methods of their production are further described at in U.S. Pat. No. 9,517,955 to Buschmann and U.S. patent application Ser. No. 15/371,872 to Buschmann, both of which are incorporated in their entirety herein.

In some embodiments, thermal acceleration of the reaction(s) that produce ROS, especially singlet oxygen, from the "parent" peracetate formulation is particularly important to performance. In some embodiments increasing the temperature of the peracetate oxidant in pulp treatment accelerates bleaching rate by increasing the production rate and concentration of ROS. In some embodiments, heating or thermal acceleration or activation of peracetate oxidant solutions to a temperature between about 50° C. to about 95° C. accelerates the formation of ROS (singlet oxygen) from a "parent" peracetate formulation to increase rates of bleaching with increasing temperature.

It was unexpectedly discovered that extraction of lignin from pulp with singlet oxygen increased the amount of lignin and other colored materials that could be extracted in subsequent stages by alkaline hydrogen peroxide and chlorine dioxide such that much less $ClO_2$ may be used to achieve high brightness levels. It was discovered that the amount of lignin and other materials extracted into the liquors of chlorine dioxide and alkaline hydrogen peroxide stages, which were two or more stages after singlet oxygen treatment, increased in proportion to the amount of singlet oxygen used. This discovery was made by examining the extracted materials in the liquors recovered from each bleach stage using ultraviolet and visible (UV-Vis) absorption spectroscopy.

FIG. 1 shows examples of UV-Vis absorption spectra of alkaline hydrogen peroxide liquors drained from north American hardwood and softwood (pine) sulfide pulps after conventional oxygen delignification. Liquors from singlet oxygen and chlorine dioxide stages have similar characteristic absorption spectra features. The absorption band centered around 280 nm is a characteristic of lignin. The absorption band centered around 350 nm is associated with the ionized, anion forms of phenols and hydroquinones in the extracted lignin. This absorbance band extends into the visible part of the spectrum (greater than about 380 nm) and imparts yellow color to pulp. The very broad absorption that extends above 420 nm tends to impart more orange to red hues to pulp. Removing materials from pulp that contribute to the 350 and 420 nm absorption band intensities is important to producing brighter and whiter pulp fiber. The more materials extracted into the liquors the greater the intensity of the absorption bands. It was generally found that the intensities of these characteristic absorption bands, and corresponding amounts of extracted materials, from the final $ClO_2$ and alkaline peroxide stages increased with increasing amount of singlet oxygen used earlier in the bleach sequence. These trends were observed for hardwood and softwood pulps as described in the examples.

In an embodiment, measuring and analyzing the UV-Vis absorption spectra of liquors from a bleaching sequence provides a method of monitoring pulp bleaching performance, a method of controlling the amount of chemistry used in a specific bleaching stage to control the brightness achieved in a specific bleaching stage or in a subsequent stage or stages.

The UV-Vis absorption spectra of liquors after each stage in a pulp bleaching sequence may be correlated with the amount of chemistry used in a specific bleaching step to achieve a specified brightness of pulp. For example, it was found that characteristic absorption band intensities of liquors from the D and $P_2$ stages increased with increasing singlet oxygen treatment (increasing peracetate concentration) to achieve an increasing level of pulp brightness in the 1O $P_1$ D $P_2$ bleach sequence. Characteristic absorption band intensities of liquors from the D stage could be increased by increasing the amount of chlorine dioxide used to achieve an increasing level of pulp brightness. Characteristic absorption band intensities of liquors from the 1O and $P_1$ stage were dependent on the amount of singlet oxygen treatment (peracetate concentration) and/or hydrogen peroxide concentration, and/or pH of the hydrogen peroxide treatment. Depending on the process conditions, the absorption band intensities increased or decreased in response to changing one or more of these parameters.

The UV-Vis absorption spectra of liquors may be measured continuously during a pulp bleaching process using a spectrometer outfitted with a flow-through sample chamber for slip-stream analysis of liquors separated from the bleaching process. The UV-Vis absorption spectra of liquors may be measured continuously during a pulp bleaching process using a spectrometer outfitted with a multi-fiber optical cable apparatus or other suitable optical apparatus that may be inserted into a process stream. Such apparatuses would allow for real-time bleaching process monitoring and control feedback data to be generated and used to control chemical use in a bleaching process and to provide a method of quality control in a bleaching process.

It was unexpectedly discovered that delignification and brightening with singlet oxygen could cause an increase in the measured viscosity of pulp fiber. This discovery indicates that the singlet oxygen ROS formulation may not have a significant negative impact on the pulp fiber's cellulosic structure. Under natural pH or pulp pH conditions in a mill fiber line (e.g., pH 6.0-10.8) the singlet oxygen ROS formulation can have little to no impact on pulp viscosity in a bleach sequence.

Figure 2:
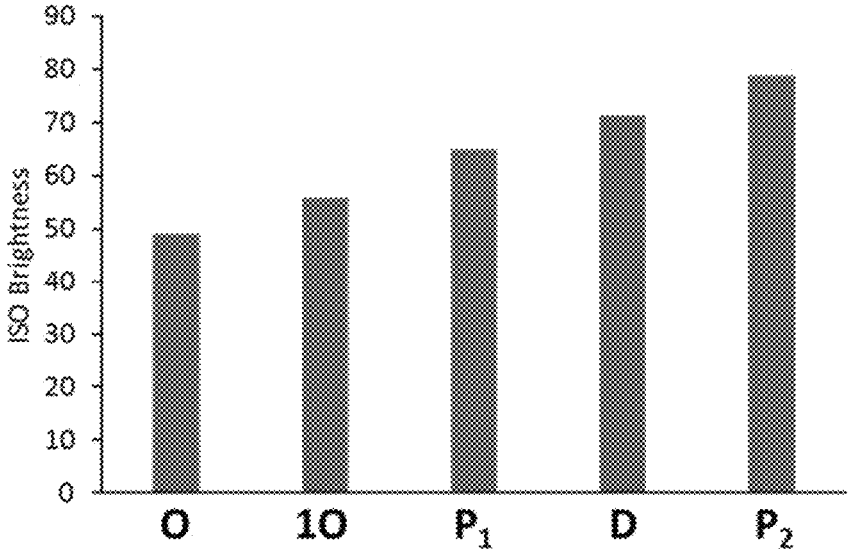
FIG. 2 depicts pulp brightness of the initial oxygen delignified hardwood, O, and after each stage of the bleach sequence 1O P D P.

FIG. 2 depicts the brightness of pulp after each bleach stage for a north American hardwood pulp, after sulfide pulping and conventional oxygen delignification stages, O, bleached with the following sequence: 1O P D P where 1O is singlet oxygen, P is alkaline hydrogen peroxide and D is chlorine dioxide. Pulp consistency was 5% during each bleach stage at 75° C. The singlet oxygen stage was provided by a 800 mg/kg charge of peracetate (added as a 2% sodium peracetate solution formulation) to the pulp. The initial oxygen delignified pulp had a brightness of 49.10% ISO. After the singlet oxygen stage the brightness was 55.87% ISO. The alkaline hydrogen peroxide stage increased brightness to 64.90% ISO. The $ClO_2$ stage increased brightness to 71.38% ISO. The final alkaline peroxide stage increased brightness to 78.88% ISO. This sequence used only 4 lb $ClO_2$ per oven dry ton of pulp as compared to between about 45 to 90 lbs $ClO_2$ per oven dry ton of pulp commonly used in ECF bleaching sequences to produce market pulp with a brightness of 85% ISO.

Consistent with the UV-Vis absorption spectra trends for the D and P liquors, when the peracetate charge for the singlet oxygen stage increased from 600 to 800 to 1000 mg/kg pulp and all other stages were kept the same the corresponding final brightness values increased from 76.78 to 78.88 to 79.57% ISO, respectively.

Figure 3:
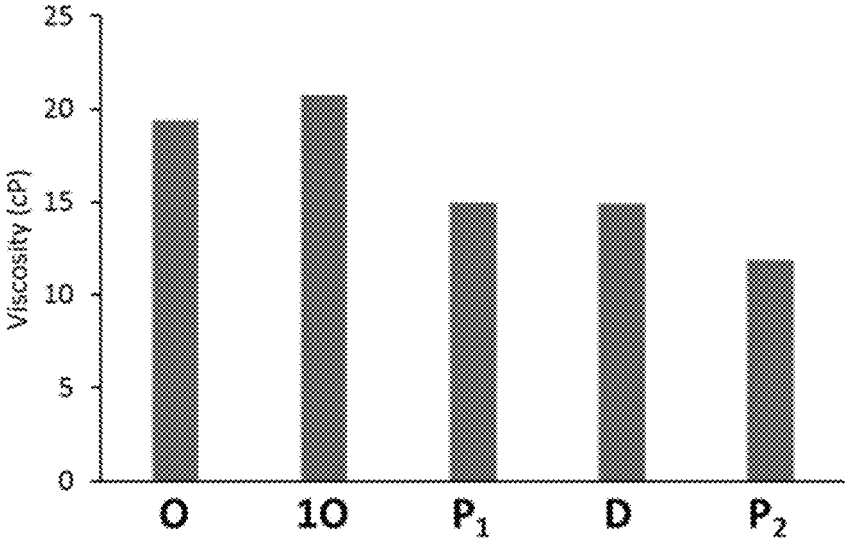
FIG. 3 depicts fiber viscosity of the initial oxygen delignified hardwood, O, and after each stage of the bleach sequence 1O P D P.

FIG. 3 depicts viscosity of the above north American hardwood pulp treated with 800 mg/kg peracetate (added as a 2% sodium peracetate solution formulation) in the singlet oxygen stage. The bleach sequence was 1O P D P. The initial oxygen delignified pulp had a viscosity of 19.42 centipoise (cP). After the singlet oxygen stage the viscosity increased slightly to 20.76 cP. The alkaline hydrogen peroxide stage decreased the viscosity to 15.02 cP. The $ClO_2$ stage decreased the viscosity only slightly to 14.92 cP. The final alkaline peroxide stage decreased viscosity to 11.87. The increase in viscosity after the singlet oxygen stage is unusual and unexpected relative to the impact it had on the rest of the bleaching sequence. The dramatic reduction in $ClO_2$ use in this sequence minimized its impact on viscosity. The alkaline peroxide stages were the most damaging to the pulp fiber with the largest viscosity decreases. The conditions for the P stages may be optimized to reduce the degradative impact of the P stages on viscosity by using standard practices including optimizing the amount of hydrogen peroxide and alkali used, adding a chelation wash before the first P stage or adding magnesium sulfate with the P stage.

In the methods described herein an unexpected discovery was that using singlet oxygen in a bleaching sequence increased pulp brightness with significantly less corresponding reduction in kappa number than conventionally bleached pulps (e.g., ECF bleach sequences). Pulp yield has been correlated with kappa number in the pulp industry and this correlation is generally consistent for each wood species. For example, hardwood species like spruce and birch bleached to a brightness of 85% ISO typically have a kappa number of about 1. The result of higher kappa numbers being obtained at higher brightness values indicates that the pulp yield for bleached grades can be increased by using at least one singlet oxygen stage in a bleaching sequence.

Figure 4:
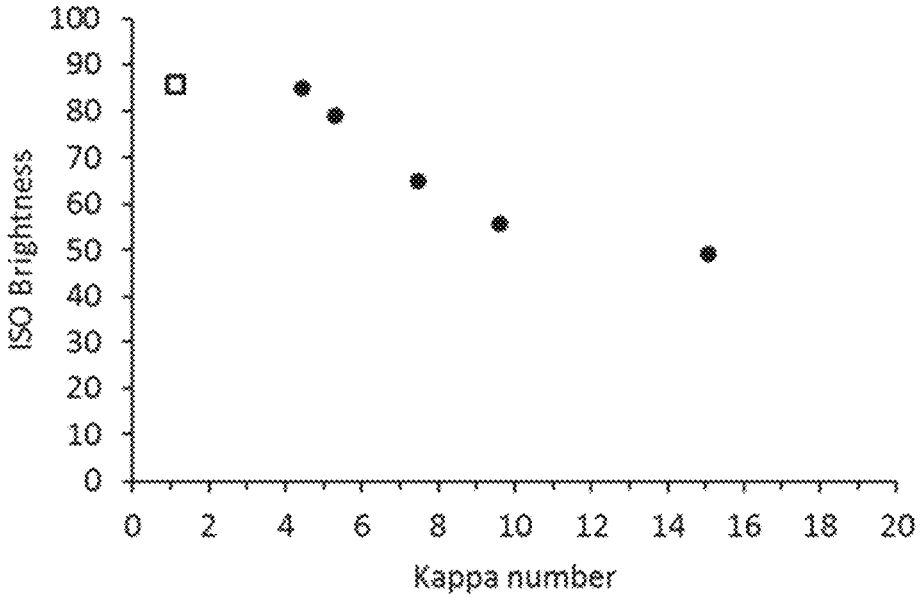
FIG. 4 depicts ISO brightness versus kappa number of hardwood samples analyzed at various points before, during and after the bleach sequences 1O P D P and 1O Q P D P (solid circles). A bleached market pulp control sample was also analyzed (open square).

FIG. 4 shows ISO brightness vs kappa number for the above north American hardwood pulp, treated with 800 mg/kg peracetate (added as a 2% sodium peracetate solution formulation) in the singlet oxygen stage. The solid circles show the relationship between ISO brightness and kappa number for pulp bleaching sequences incorporating 1O P and 1O Q P relative to market pulp (open square) bleached with a conventional ECF bleach sequence. The initial pulp before bleaching had a 49.10% ISO brightness with a kappa number of 15.05. After the 1O stage the pulp had a 55.87% ISO brightness with a kappa number of 9.60. After a 1O P sequence the pulp had a 64.90% ISO brightness with a kappa number of 7.46. After a 1O P D P sequence the pulp had a 78.88% ISO brightness with a kappa number of 5.31. After a 1O Q P D P sequence the pulp had a 85.10% ISO brightness with a kappa number of 4.42. Hardwood market pulp was analyzed as a standard control sample and had a 85.76% ISO brightness with a kappa number of 1.11.

A brightness of 85.10% ISO was achieved at a kappa number of 4.42, which was four times greater than the kappa number of standard hardwood market pulp with 85.76% ISO brightness. These results demonstrate that the use of singlet oxygen and alkaline hydrogen peroxide enables the oxidation and removal of colored materials from pulp without removing as much material from the pulp as conventional ECF bleaching (e.g., oxygen delignification followed by D E D D bleach sequence) used to produce market pulp. The higher kappa number at a given brightness when using singlet oxygen and alkaline hydrogen peroxide corresponds to removing less mass of pulp during bleaching, which may provide a greater pulp yield than conventional ECF bleaching.

In some embodiments, singlet oxygen may very rapidly oxidize and extract a portion of lignin and non-lignin colored materials from pulp while making residual materials that remain in the pulp fiber more readily extractable in subsequent bleaching stages. Residual materials may be bound or unbound to pulp fiber structures including hemicellulose structures and cellulose structures. Subsequent bleaching stages may include alkaline hydrogen peroxide, chlorine dioxide, ozone and peracetic acid. In one embodiment, a singlet oxygen stage, 1O, is followed by an alkaline hydrogen peroxide stage, P, to significantly increase brightness and reduce the amount of $ClO_2$ required in an ECF bleaching sequence. A chelating wash stage, Q, may be used just prior to an alkaline hydrogen peroxide stage, but after the 1O stage. A chelating agent used in Q stage may include ethylenediaminetetraacetic acid (EDTA) and diethylenetriaminepentaacetic acid (DTPA). An alkaline hydrogen peroxide stage may include the use of a magnesium salt such as magnesium sulfate. An alkaline hydrogen peroxide stage may be followed by a singlet oxygen stage. A chlorine dioxide stage, D, may be conducted after an alkaline hydrogen peroxide stage. A chlorine dioxide stage may be followed by subsequent chlorine dioxide, peracetic acid, Paa, alkaline extraction, E, and/or alkaline hydrogen peroxide stages. An ozone stage, Z, may be used before or after any such stages listed above.

In one embodiment, a preferred bleaching sequence may include 1O P which may be followed by additional bleaching stages. In some embodiments, the bleaching sequence may be chosen from the following examples: (these examples are not meant to be limiting)

1O P
1O Q P
1O P 1O P
1O P Z E
1O P D P
1O Q P D P
1O Q P 1O P
1O P D D
1O P D P D
1O P D E D
1O P 1O P D P
1O P Paa P D P
1O P D Paa P
1O P Z E D P
Z E 1O P
Z E 1O P D P.

In a preferred embodiment, a bleaching sequence may be singlet oxygen, followed by chelation, followed by alkaline hydrogen peroxide, where the bleaching sequence is represented as 1O Q P. This bleaching sequence may achieve pulp brightness of 60% ISO or greater without further bleaching steps.

In a preferred embodiment, a bleaching sequence may be singlet oxygen, followed by chelation, followed by alkaline hydrogen peroxide, followed by chlorine dioxide, followed by alkaline hydrogen peroxide, where the bleaching sequence is represented as 1O Q P D P. This bleaching sequence may achieve pulp brightness of 80% ISO or greater without further bleaching steps.

The impact of singlet oxygen in the bleach sequence 1O P D P was demonstrated on a north American hardwood pulp. The initial oxygen delignified pulp had a kappa number of 15.05 and brightness of 49.10% ISO. The peracetate charge for the singlet oxygen stage was 800 mg/kg pulp. After the singlet oxygen stage the kappa number was 9.60 and brightness was 55.87% ISO. After the first alkaline peroxide stage the kappa number was 7.46 at and brightness was 64.90% ISO. After using chlorine dioxide (4.0 lbs per oven dry ton pulp) and a second alkaline peroxide stage the kappa number was 5.31 and brightness was 78.88% ISO.

When the peracetate charge for the singlet oxygen stage was increased to 1000 mg/kg pulp and all other stages were kept the same the final kappa number was 6.88 and brightness was 79.57% ISO. When the peracetate charge for the singlet oxygen stage was decreased to 600 mg/kg pulp and all other stages were kept the same the final kappa number was 6.12 and brightness was 76.78% ISO. The kappa numbers for the three trials described is significantly greater than the market pulp suggesting that using a singlet oxygen stage and very little chlorine dioxide can extract less material from the pulp, yet still achieve high brightness levels. Increasing the amount of singlet oxygen used in the bleaching sequence was repeatedly found to increase the final kappa number of the pulp after the entire bleaching sequence when all other variables were held constant. In some embodiments, the singlet oxygen chemistry provided by the ROS formulation modifies the pulp in a manner that serves to protect non-colored materials in the pulp from oxidation and extraction in subsequent bleaching stages.

A bleach sequence consisting of 1O QPDP was used to demonstrate the impact of an EDTA chelating wash stage on pulp quality for a north American hardwood pulp, treated with 800 mg/kg peracetate (added as a 2% sodium peracetate solution formulation) in the singlet oxygen stage. After the 1O, Q and P stages the kappa number was 5.67, brightness was 71.80% ISO and viscosity was 20.43 cP. After using chlorine dioxide (8.0 lbs per oven dry ton pulp) and a second alkaline peroxide stage the kappa number was 4.42, brightness was 85.01% ISO and viscosity was 15.07 cP. Viscosity was preserved through the first alkaline peroxide stage by the chelating wash stage at a value greater than the initial pulp (14.47 cP). The final bleached pulp viscosity was only 4.35 cP lower than the initial unbleached pulp viscosity. An additional benefit of adding the Q stage was increasing brightness of the pulp by about 6.9% ISO after the 1O, Q and P stages compared to just using 1O and P stages.

In another embodiment, a bleaching sequence may be singlet oxygen, followed by chelation, followed by alkaline hydrogen peroxide, followed by singlet oxygen, followed by alkaline hydrogen peroxide, where the bleaching sequence is represented as 1O Q P 1O P. This bleaching sequence may achieve pulp brightness of 60% ISO or greater, 70% ISO or greater, or 80% ISO or greater without further bleaching steps.

EXAMPLES

Having now described the invention, the same will be more readily understood through reference to the following example(s), which are provided by way of illustration, and are not intended to be limiting of the present invention.

Test methods: Kappa numbers were measured in duplicate or triplicate using a micro-Kappa procedure that used 0.5 g of oven dried pulp fiber mass (¼-scale of the standard TAPPI T 236 om-99 method). Kappa number measurements were conducted on pulp samples stored damp after determining the percent solids of each sample.

The pH of pulp mixtures was measured with a high sodium pH electrode put directly into the pulp slurry. A thermocouple for temperature compensation of the pH reading was placed in the pulp during measurement.

Viscosity was measured by the following procedure. Pulp sample was disintegrated and diluted. The slurry was filtered through a filter paper in a Buchner funnel. The resulting pulp pad was dried at room temperature and solids content was determined. Viscosity of the pulp sample was measured by following Tappi standard T230 with closed bottle procedure. The reported value is an average of two measurements.

Brightness measurements were conducted by the following procedure. Pulp sample was disintegrated in a standard disintegrator at 3000 rpm for 30 seconds. The slurry was diluted and hand sheet was prepared by following Tappi standard procedure T205. Brightness of the air-dry hand sheet was measured in a brightness meter (TECHNIBRITE MODEL MICRO TB-1C). Eight measurements were taken for each hand sheet sample: four measurements from each side. The reported value is the average of eight measurements.

The relative amounts of lignin and other materials extracted in each stage of a bleaching sequence were monitored and quantified by measuring the ultraviolet and visible (UV-Vis) absorption spectra of liquors drained from individual pulp bleaching stages. An example is shown in FIG. 1. Several characteristic absorption bands in the UV-Vis spectra of the liquors were evaluated for their intensity, which were compared between bleaching sequences using systematically varied amounts of chemistry in each stage. The UV-Vis analysis of liquors made it possible to rapidly monitor the impact of a chemical treatment stage on lignin extraction. Several pulp samples throughout the bleaching sequences were analyzed by kappa number, viscosity and brightness measurements.

To directly compare absorption spectra intensity pulp samples were chemically treated at 5% consistency and 75° C. in each bleaching stage. Liquors drained off the pulp were collected for analysis before the pulp was washed with tap water. UV-Vis spectra were measured using an appropriate dilution of the liquor samples with distilled water and pH adjustment to about pH 10.8-11.4 with 4 molar NaOH. The alkaline sample pH adjustment put the phenolic lignin and oxidized byproducts in their more water soluble and stronger absorbing, ionized forms. The intensity of characteristic absorption bands centered around 280, 350 and 420 nm were compared on an absolute scale (measured absorbance multiplied by a liquor sample's dilution factor).

Hardwood Bleaching example 1: A North American hardwood sulfate pulp after oxygen delignification was used to demonstrate the impact of a singlet oxygen stage on the bleaching sequence: 1O $P_1$ D $P_2$, where the subscripts distinguish between different steps with the same abbreviation but not necessarily the same process parameters. The pulp had a consistency of 15.3%, an initial kappa number of 15.05, initial brightness of 49.10% ISO and initial viscosity of 19.42 cP. Each treatment stage of the bleaching sequence was conducted at 5% consistency (consistency adjusted with distilled water plus chemical charge) with samples hand mixed for 2-3 minutes and held at 75° C. in a heated water bath. Pulp samples were pre-heated in a microwave oven in 1 L glass beakers prior to adding treatment chemicals. After a stage's treatment time the pulp was drained in a Buchner funnel over medium filter paper and a portion of the liquor collected for UV-Vis analysis. Then the pulp was washed with a fixed amount of warm tap water (e.g., 200 g of the original 15.3% consistency pulp was washed with 1200 mL water). The thickened pulp was then recovered and treated in the next stage of the sequence. Pulp samples of each stage were prepared and stored damp and refrigerated (about 3-6° C.) prior to fiber analyses for kappa number, brightness and viscosity.

Each of the three trial sequences was conducted using the same parameters except for the amount of singlet oxygen used, which was determined by the charge of sodium peracetate formulation in the pulp. The singlet oxygen stage, 1O, was conducted by rapidly mixing into the pre-heated pulp with the appropriate volume of 2.0% peracetate solution (excluding the molecular weight of sodium) to make initial concentrations of 600, 800 and 1000 mg/kg in the 5% consistency pulp (trial sequences 1, 2 and 3, respectively). The 1O stage was held at temperature for 5 minutes in all trials. In subsequent stages the same chemical charge was used for each trial sequence. Stage $P_1$ used 900 mg/kg hydrogen peroxide and 1700 mg/kg sodium hydroxide in 5% consistency pulp (post-mixing pulp pH was about 11.3). Stage $P_1$ was held at temperature for 30 minutes. Stage D used 100 mg/kg chlorine dioxide (post-mixing pulp pH was about 4.4) and was held at temperature for 5 minutes. Stage $P_2$ used 600 mg/kg hydrogen peroxide and 1460 mg/kg sodium hydroxide in 5% consistency pulp (post-mixing pulp pH was about 11.4). Stage $P_2$ was held at temperature for 30 minutes.

Figure 5:
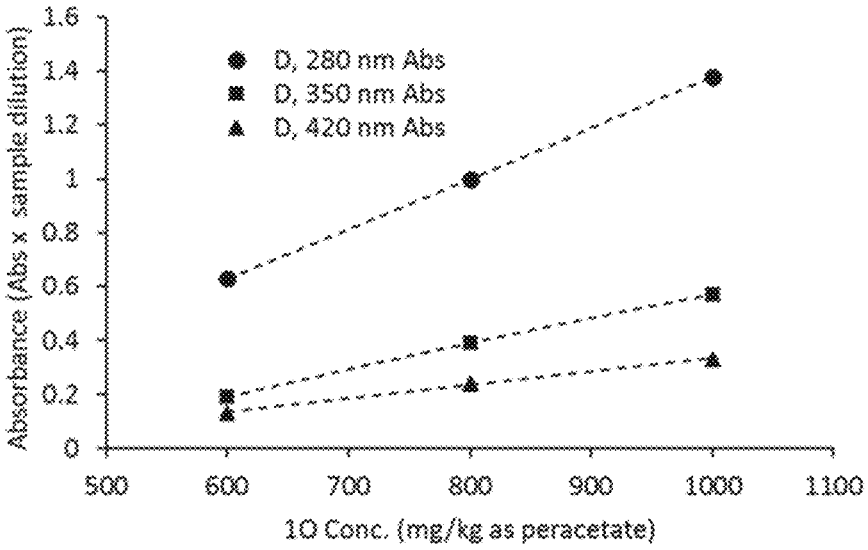
FIG. 5 depicts the relative absorbance of the 280 nm (circles), 350 nm (squares) and 420 nm (triangles) points in the hardwood UV-Vis absorbance spectra of the D stage liquors versus the 1O stage peracetate concentration. The dashed lines are provided to help guide the eye.
Figure 6:
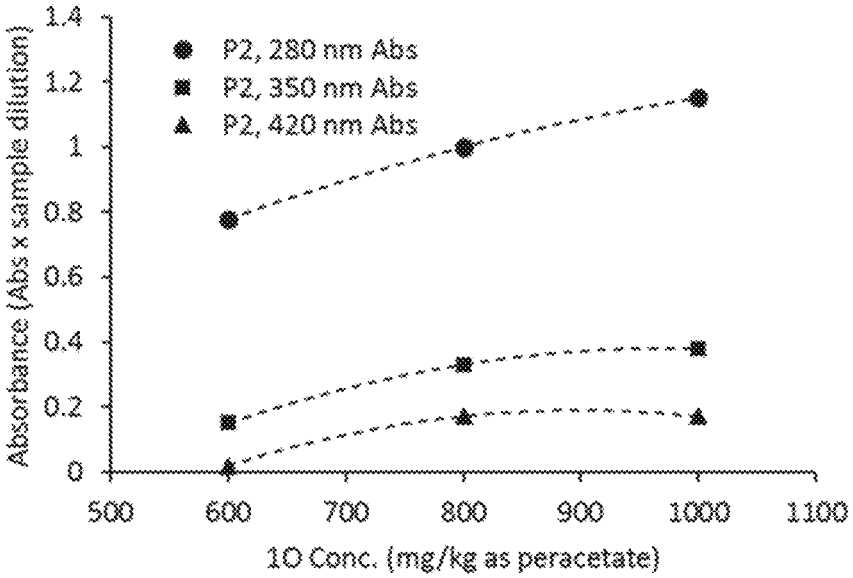
FIG. 6 depicts the relative absorbance of the 280 nm (circles), 350 nm (squares) and 420 nm (triangles) points in the hardwood UV-Vis absorbance spectra of the second, final alkaline peroxide stage liquors versus the 1O stage peracetate concentration. The dashed lines are provided to help guide the eye.

UV results: The absorbance intensity at 280, 350 and 420 nm in the UV-Vis absorbance spectra of the liquors recovered from the D and $P_2$ stages in the three bleaching sequence trials increased with increasing initial concentration of peracetate in the singlet oxygen stage, 1O. FIG. 5 shows the extraction of optically absorbing materials by chlorine dioxide, D, increases with increasing amount of singlet oxygen. FIG. 6 shows the extraction of optically absorbing materials by alkaline hydrogen peroxide, $P_2$, after the chlorine dioxide stage, increases with increasing amount of singlet oxygen.

Fiber results: For trial sequence 1 (600 mg/kg initial peracetate) the final post-$P_2$ fiber analyses were kappa number 6.12, brightness 76.78% ISO and viscosity 12.85 cP. For trial sequence 2 (800 mg/kg initial peracetate) the final post-$P_2$ fiber analyses were kappa number 5.31, brightness 78.88% ISO and viscosity 11.87 cP. For trial sequence 3 (1000 mg/kg initial peracetate) the final post-$P_2$ fiber analyses were kappa number 6.88, brightness 79.57% ISO and viscosity 11.66 cP.

For trial sequence 2 (800 mg/kg initial peracetate) fiber analyses were also conducted after each stage in the sequence. After 1O the fiber analyses were kappa number 9.60, brightness 55.87% ISO and viscosity 20.76 cP. After $P_1$ the fiber analyses were kappa number 7.46, brightness 64.90% ISO and viscosity 15.02 cP. After D the fiber analyses were brightness 71.38% ISO and viscosity 14.92 cP. After $P_2$ the fiber analyses were kappa number 5.31, brightness 78.88% ISO and viscosity 11.87 cP.

Hardwood Bleaching example 2: A north American hardwood sulfate pulp after oxygen delignification was used to demonstrate the impact of a singlet oxygen stage on the bleaching sequence: 1O Q $P_1$ D $P_2$, where the subscripts distinguish between different steps with the same abbreviation but not necessarily the same process parameters. The pulp had a consistency of 15.3% an initial kappa number of 15.05, initial brightness of 49.10% ISO and initial viscosity of 19.42 cP. Each treatment stage of the bleaching sequence was conducted at 5% consistency (consistency adjusted with distilled water plus chemical charge) with samples hand mixed for 2-3 minutes and held at 75° C. in a heated water bath. Pulp samples were pre-heated in a microwave oven in 1 L glass beakers prior to adding treatment chemicals. After a stage's treatment time the pulp was drained in a Buchner funnel over medium filter paper and a portion of the liquor collected for UV-Vis analysis. Then the pulp was washed with a fixed amount of warm tap water (e.g., 200 g of the original 15.3% consistency pulp was washed with 1200 mL water). The thickened pulp was then recovered and treated in the next stage of the sequence. Pulp samples of each stage were prepared and stored damp and refrigerated (about 3-6° C.) prior to fiber analyses for kappa number, brightness and viscosity.

The singlet oxygen stage, 1O, was conducted by rapidly mixing into the pre-heated pulp the appropriate volume of 2.0% peracetate solution (excluding the molecular weight of sodium) to make initial concentrations of 800 mg/kg in the 5% consistency pulp. The 1O stage was held at temperature for 5 minutes. The chelation wash stage, Q, used 0.4 wt % EDTA per oven dry ton of pulp, which was mixed into the pulp and the pulp pH adjusted to pH 5.0 with dilute sulfuric acid. This mixture was held at temperature for 5 min before draining. Stage $P_1$ used 900 mg/kg hydrogen peroxide and 1700 mg/kg sodium hydroxide in 5% consistency pulp (post-mixing pulp pH was about 11.3). Stage $P_1$ was held at temperature for 30 minutes. Stage D used 200 mg/kg chlorine dioxide (post-mixing pulp pH was about 3.2) and was held at temperature for 5 minutes. Stage $P_2$ used 600 mg/kg hydrogen peroxide and 1460 mg/kg sodium hydroxide in 5% consistency pulp (post-mixing pulp pH was about 11.4). Stage $P_2$ was held at temperature for 30 minutes.

Fiber results: After the 1O, Q and P stages the kappa number was 5.67, brightness was 71.80% ISO and viscosity was 20.43 cP. After using chlorine dioxide (8.0 lbs per oven dry ton pulp) and a second alkaline peroxide stage the kappa number was 4.42, brightness was 85.01% ISO and viscosity was 15.07 cP. Viscosity was preserved through the first alkaline peroxide stage by the chelating wash stage at a value greater than the initial pulp (14.47 cP). The final bleached pulp viscosity was only 4.35 cP less than the initial unbleached pulp viscosity. An additional benefit of adding the Q stage was increasing brightness of the pulp by about 6.9% ISO after the 1O, Q and P stages compared to just using 1O and P stages in the preceding example.

Softwood Bleaching example: A north American softwood (pine) sulfate pulp after oxygen delignification was used to demonstrate the impact of two singlet oxygen stages on the bleaching sequence: $1O_1$ $P_1$ $1O_2$ $P_2$ D $P_3$. The pulp had a consistency of 16.2% an initial kappa number of 38.66. Each treatment stage of the bleaching sequence was conducted at 5% consistency (consistency adjusted with distilled water plus chemical charge) with samples hand mixed for 2-3 minutes and held at 80° C. in a heated water bath. Pulp samples were pre-heated in a microwave oven in 1 L glass beakers prior to adding treatment chemicals. After a stage's treatment time the pulp was drained in a Buchner funnel over medium filter paper and a portion of the liquor collected for UV-Vis analysis. Then the pulp was washed with a fixed amount of warm tap water (e.g., 200 g of the original 16.2% consistency pulp was washed with 1200 mL water). The thickened pulp was then recovered and treated in the next stage of the sequence. Pulp samples of each stage were prepared and stored damp and refrigerated (about 3-6° C.) prior to fiber analyses for kappa number.

Each of the two trial sequences were conducted using the same parameters except for the amount of singlet oxygen used in the first stage, $1O_1$, which was determined by the charge of sodium peracetate formulation in the pulp. The $1O_1$ stage was conducted by rapidly mixing into the pre-heated pulp the appropriate volume of 2.0% peracetate solution (excluding the molecular weight of sodium) to make initial concentrations of 800 and 1100 mg/kg in the 5% consistency pulp (trial sequences 1 and 2 respectively). The 1O stage was held at temperature for 5 minutes in all trials. In subsequent stages the same chemical charge was used for each trial sequence. Stage $P_1$ used 900 mg/kg hydrogen peroxide and 1800 mg/kg sodium hydroxide in 5% consistency pulp (post-mixing pulp pH was about 11.5). Stage $P_1$ was held at temperature for 30 minutes. Stage $1O_2$ used 600 mg/kg peracetate and was held at temperature for 5 minutes. Stage $P_2$ used 800 mg/kg hydrogen peroxide and 1500 mg/kg sodium hydroxide in 5% consistency pulp (post-mixing pulp pH was about 11.4). Stage $P_2$ was held at temperature for 30 minutes. Stage D used 100 mg/kg chlorine dioxide (post-mixing pulp pH was about 4.4) and was held at temperature for 5 minutes. Stage $P_2$ used 600 mg/kg hydrogen peroxide and 1100 mg/kg sodium hydroxide in 5% consistency pulp (post-mixing pulp pH was about 11.2). Stage $P_2$ was held at temperature for 30 minutes.

Figure 7:
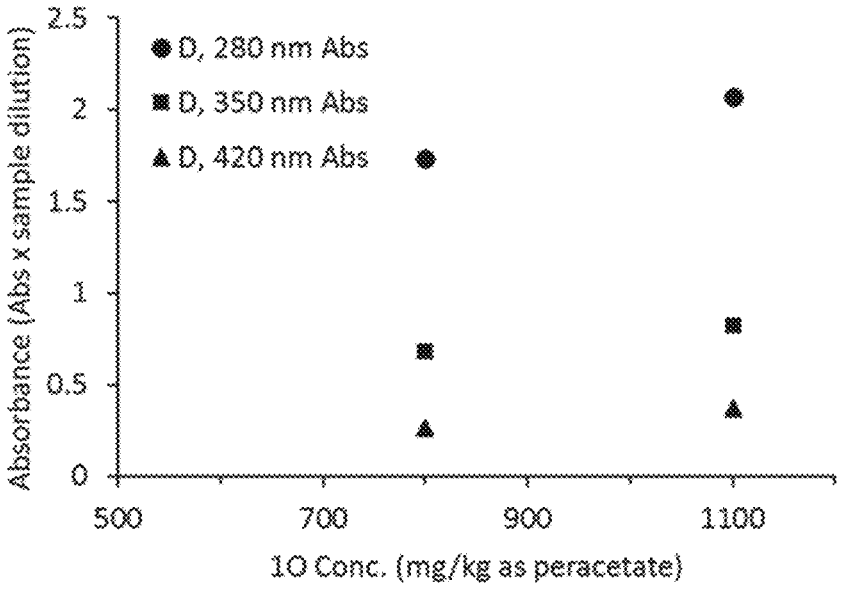
FIG. 7 depicts the relative absorbance of the 280 nm (circles), 350 nm (squares) and 420 nm (triangles) points in the softwood UV-Vis absorbance spectra of the D stage liquors versus the 1O stage peracetate concentration.
Figure 8:
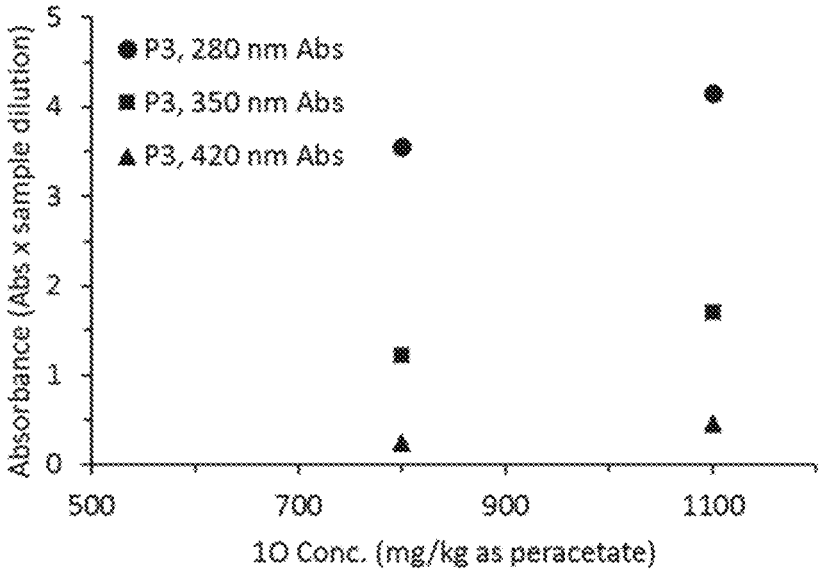
FIG. 8 depicts the relative absorbance of the 280 nm (circles), 350 nm (squares) and 420 nm (triangles) points in the softwood UV-Vis absorbance spectra of the second, final alkaline peroxide stage liquors versus the 1O stage peracetate concentration.

UV results: The absorbance intensity at 280, 350 and 420 nm in the UV-Vis absorbance spectra of the liquors recovered from the D and $P_3$ stages in the three bleaching sequence trials increased with increasing initial concentration of peracetate in the $1O_1$ singlet oxygen stage. FIG. 7 shows the extraction of optically absorbing materials by chlorine dioxide, D, increases with increasing amount of singlet oxygen. FIG. 8 shows the extraction of optically absorbing materials by alkaline hydrogen peroxide, $P_3$, after the chlorine dioxide stage, increases with increasing amount of singlet oxygen.

The UV-Vis absorbance results suggest that the amount of material extracted in the D and $P_3$ stages is influenced by the combined total amount of singlet oxygen used in the bleach sequence incorporating multiple 1O stages.

Substituting the $1O_2$ stage with a Paa stage was less effective in brightening and resulted in less lignin extraction during the D and $P_3$ stages as measured by the UV-Vis absorbance of liquor extracts. The use of an acidic peracid treatment step may be useful in other bleaching sequences and with other fiber species that can benefit from an oxidative peracid hydrolysis treatment step. A hydrogen peroxide-free peracid solution can be produced by addition of an acid to pulp containing the peracetate formulation when the pH of the pulp is reduced to less than pH 6. An acid may include sulfuric acid, hydrochloric acid, nitric acid, phosphoric acid, sodium bisulfate, sulfamic acid, acetic acid and citric acid.

Conducting the above sequences at 15% pulp consistency gave the same trends in the UV-Vis absorbance of liquor extracts from the D and $P_3$ stages.

Fiber results: For trial sequence 1 (800 mg/kg initial peracetate) the post-$P_3$ fiber kappa number was 13.77 and the brightness was estimated to be approximately 55-60% ISO. For trial sequence 2 (1100 mg/kg initial peracetate) the post-$P_3$ fiber kappa number was 11.70 and the brightness was estimated to be approximately 55-60% ISO. The pulp brightness was visibly greater for trial sequence 2.

In this patent, certain U.S. patents, U.S. patent applications, and other materials (e.g., articles) have been incorporated by reference. The text of such U.S. patents, U.S. patent applications, and other materials is, however, only incorporated by reference to the extent that no conflict exists between such text and the other statements and drawings set forth herein. In the event of such conflict, then any such conflicting text in such incorporated by reference U.S. patents, U.S. patent applications, and other materials is specifically not incorporated by reference in this patent.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A method of bleaching pulp, comprising a bleaching process including a bleaching sequence comprising:

first contacting a pulp with a singlet oxygen source; and after the first contacting, second contacting the pulp with an alkaline peroxide source;

wherein the singlet oxygen source comprises a peracetate oxidant solution comprising peracetate anions and a peracid, and wherein the peracetate oxidant solution as added to the pulp for the first contacting has a pH from about pH 10 to about pH 12 and a molar ratio of peracetate anions to peracid ranging from about 60:1 to about 6000:1; and wherein the bleaching process comprises subjecting the pulp in multiple stages to the bleaching sequence.

2. The method of claim 1, wherein following the bleaching process the resulting bleached pulp comprises a pulp brightness of about 80% ISO or greater.

3. The method of claim 1, further comprising, prior to the first contacting, subjecting the pulp to oxygen delignification.

4. The method of claim 1, wherein treated pulp resulting from the second contacting comprises a pulp brightness of about 60% ISO or greater.

5. The method of claim 1, wherein treated pulp resulting from the second contacting of a final said bleaching sequence comprises a pulp brightness of about 85% ISO or greater.

6. The method of claim 1, wherein the bleaching sequence is in the absence of contacting the pulp with chlorine dioxide between and during the first contacting and the second contacting.

7. The method of claim 6, wherein the bleaching sequence includes, between the first contacting and the second contacting, intermediate contacting the pulp with a chelating agent.

8. The method of claim 1, wherein the bleaching sequence includes, between the first contacting and the second contacting, intermediate contacting the pulp with a chelating agent.

9. The method of claim 1, comprising in a first said stage subjecting the pulp to a first said bleaching sequence and in a second said stage subjecting the pulp to a second said bleaching sequence, and wherein:

the first said bleaching sequence and the second said treating bleaching sequence are each in the absence of contacting the pulp with chlorine dioxide between and during the first contacting and the second contacting.

10. The method of claim 9, wherein the first said bleaching sequence comprises, between the first contacting and the second contacting, intermediate contacting the pulp with a chelating agent.

11. The method of claim 9, wherein the bleached pulp resulting from the second contacting of the second said bleaching sequence comprises a pulp brightness of about 60% ISO or greater.

12. The method of claim 9, further comprising, after the second contacting of the second said bleaching sequence, contacting the pulp with chlorine dioxide.

13. The method of claim 10, wherein the bleached pulp resulting from the second contacting of the second said bleaching sequence comprises a pulp brightness of about 80% ISO or greater.

14. The method of claim 13, wherein the bleaching process is totally chlorine free.

15. The method of claim 9, further comprising:

monitoring at least one of absorbance spectra of bleaching liquors, kappa number, fiber brightness, or fiber viscosity; and optimizing a said bleaching sequence based upon the monitored values.

16. The method of claim 9, wherein the bleaching process is in the absence of contacting the pulp with chlorine dioxide.

17. The method of claim 9, wherein the peracetate oxidant solution comprises a molar ratio of peracetate to hydrogen peroxide of greater than 16:1.

18. The method of claim 1, wherein the peracetate oxidant solution comprises a molar ratio of peracetate to hydrogen peroxide of greater than 16:1.

19. A method of bleaching pulp, comprising a bleaching process including a bleaching sequence comprising:

first contacting a pulp with a singlet oxygen source;

after the first contacting, second contacting the pulp with an alkaline peroxide source; and after the second contacting, contacting the pulp with chlorine dioxide:

wherein the singlet oxygen source comprises a peracetate oxidant solution comprising peracetate anions and a peracid, and wherein the peracetate oxidant solution as added to the pulp for the first contacting has a pH from about pH 10 to about pH 12 and a molar ratio of peracetate anions to peracid ranging from about 60:1 to about 6000:1; and wherein the bleaching sequence is in the absence of contacting the pulp with chlorine dioxide between and during the first contacting and the second contacting.

20. The method of claim 19, wherein the bleaching sequence includes, between the first contacting and the second contacting, intermediate contacting the pulp with a chelating agent.

21. The method of claim 19, wherein the peracetate oxidant solution comprises a molar ratio of peracetate to hydrogen peroxide of greater than 16:1.

22. The method of claim 21, further comprising, prior to the first contacting, subjecting the pulp to oxygen delignification.

23. A method of bleaching pulp, comprising:

first contacting a pulp with a singlet oxygen source;

after the first contacting, second contacting the pulp with a chelating agent;

after the second contacting, third contacting the pulp with an alkaline peroxide source;

after the third contacting, fourth contacting the pulp with chlorine dioxide; and after the fourth contacting, fifth contacting the pulp with an alkaline peroxide source;

and wherein:

the singlet oxygen source comprises a peracetate oxidant solution comprising peracetate anions and a peracid, and wherein the peracetate oxidant solution as added to the pulp for the first contacting has a pH from about pH 10 to about pH 12 and a molar ratio of peracetate anions to peracid ranging from about 60:1 to about 6000:1;

the peracetate oxidant solution comprises a molar ratio of peracetate to hydrogen peroxide of greater than 16:1, and the method is in the absence of contacting the pulp with chlorine dioxide between and during the first contacting, the second contacting and the third contacting.

24. The method of claim 23, further comprising, prior to the first contacting, subjecting the pulp to oxygen delignification.

25. The method of claim 23, wherein the bleached pulp resulting from the fifth contacting comprises a brightness of at least 80% ISO.

* * * * *